US005334126A

United States Patent [19]

Moll

[11] Patent Number: 5,334,126

[45] Date of Patent: Aug. 2, 1994

[54] CONTROLLED PERFORATION APPARATUS FOR FOLDING MACHINES

[76] Inventor: Richard J. Moll, c/o Dick Moll & Sons, Inc., Warminster, Pa. 18974

[21] Appl. No.: 16,582

[22] Filed: Feb. 10, 1993

[51] Int. Cl.[5] ..... B26D 5/06; B26D 5/38

[52] U.S. Cl. ..... 493/22; 493/365; 493/370; 83/331; 83/350; 83/365; 83/370; 83/660

[58] Field of Search ..... 493/10, 22, 363, 364, 493/365, 366, 367, 368, 369, 370; 83/331, 350, 354, 365, 368, 370, 372, 660

[56] References Cited

U.S. PATENT DOCUMENTS

| | | | |
|---|---|---|---|
| 3,076,365 | 2/1963 | Taylor et al. | 83/63 |
| 3,165,019 | 1/1965 | Graveley | 83/300 |
| 3,699,832 | 10/1972 | Smith et al. | 83/365 |
| 3,735,659 | 5/1973 | Button | 83/660 |
| 3,855,890 | 12/1974 | Lynch et al. | 83/331 |
| 4,641,575 | 2/1987 | Cavagna | 493/442 |
| 4,950,217 | 8/1990 | Stenqvist | 493/22 |
| 5,029,506 | 7/1991 | Glendening | 83/660 |

*Primary Examiner*—William E. Terrell
*Attorney, Agent, or Firm*—Z. T. Wobensmith, III

[57] ABSTRACT

Apparatus for use with paper folding or other machines which applies a line of perforations on the paper sheets at selected locations and for controlled distances while the paper sheet is travelling through the machine.

4 Claims, 4 Drawing Sheets

CONTROLLED PERFORATION APPARATUS FOR FOLDING MACHINES

BACKGROUND OF THE INVENTION

1. Field of the Invention

This invention relates to apparatus for applying a line of perforations of controlled length to sheets of paper while they are travelling through a paper folding or other machine.

2. Description of the Prior Art

The application of a line or lines of perforation to a sheet or sheets of paper to enable a portion of the sheet to be detached at a later time is not new.

Many advertising or mailer pieces are multi-part, in that a portion of the piece can be detached and returned to the sender for a variety of purposes, such as placing an order for a product, or obtaining a catalog, responding to a survey, or other uses.

It is not always convenient to produce a return piece of a mailing by using one straight line of perforations, and often two 90° intersecting lines of perforations are needed to provide a detachable postcard sized return piece.

In order to put the intersecting lines of perforations on the mailer one common practice is to use a letter press and die which require additional labor and machine cost. Another approach is to paste a strip onto a printing roller blanket as backup for the die, but the resulting operation ruins the blanket and consequently increases the cost.

Another approach is to put in a perforation apparatus before the number I fold roller which includes a bottom roller and a perforation wheel which is brought down onto the paper sheet to be perforated.

The apparatus of the invention replaces the first set of fold rollers and selectively applies a line of perforations to a mailing piece while it is in a folding or paper processing machine, with control of the location and length of the line, so that a return mailer piece is available which can be easily detached and mailed back to the sender.

The apparatus of the invention also performs the feeding operation previously accomplished by the first set of fold rollers in the machine, which makes it useful for both old and new machines.

Various prior art structures have been proposed which perform operations such as detecting, slitting, and perforating sheets of material, but none of them perform the same as the apparatus of the invention.

The U.S. Pat. No. 3,076,365 to Taylor et al discloses a machine for slitting tissues, particularly tissues to be used as sutures, and cut from the intestines of beef, calves, sheep or swine. This apparatus is designed to be operated with wet material presented through a narrow tissue feed throat, and is not suitable for use with dry paper sheets. While the patent discloses a detection system for disclosing the presence of a strip to be split it lacks supporting rollers, is not suitable for applying perforated lines to sheets of paper, lacks the female collar with a groove below the perforation wheel, which is necessary for applying perforated lines.

The U.S. Pat. No. 3,165,019 to R. L. Graveley, Jr. discloses a re-indexing punching unit for making holes in moving strip stock, such as aluminum siding. No sheet detection system is disclosed, no rollers similar to applicant, and no adjustment whereby perforation lines can be placed on sheets of paper of selected length and at any desired transverse location.

The U.S. Pat. No. 3,855,890 to Lynch et al discloses a slitter/perforation apparatus for cutting or perforation a sheet of material, but does not disclose a sheet detection device which actuates a solenoid to cause an arm to move vertically downwardly, and engage an attached perforation wheel with sheets of material, to apply lines of perforation of selected length. The perforation roll of Lynch et al must be manually manipulated for engagement with the sheet of material for slitting or perforation.

The U.S. Pat. No. 4,641,575 to Cavagna discloses a device for embossing or creasing paper which is preferably supplied from a continuous roll. The device is intended to be *fixed* at a selected distance from the surface of the paper, such as toilet paper, and is not selectively movable to apply lines of perforations of controlled length on individual sheets of paper.

The U.S. Pat. No. 5,029,506 to Glendening discloses a paper perforation assembly which does crush-cut type perforation on a fixed shaft, sheet fed perforating machine. No sheet detection means, connected to control means, and connected to a solenoid for selectively actuating a perforating wheel is suggested in Glendening.

None of the prior art structures discloses the apparatus of the invention.

SUMMARY OF THE INVENTION

Perforating apparatus is provided that replaces the first set of fold rollers in a folding or other paper processing machine, which applies a line of perforations at a selected location and length to a sheet of paper while it is travelling through the machine.

The principal object of the invention is to provide perforation apparatus in a folding or other paper processing machine which provides a line of perforations of controlled length.

A further object of the invention is to provide apparatus of the character aforesaid which can be used with a variety of paper processing machines.

A further object of the invention is to provide apparatus of the character aforesaid which provides a line of perforations on a sheet of paper the location and length of which can be easily varied.

A further object of the invention is to provide apparatus of the character aforesaid which provides consistent high quality results.

A further object of the invention is to provide apparatus of the character aforesaid which can be constructed of readily available components.

A further object of the invention is to provide apparatus of the character aforesaid which can be used with a wide variety of sizes and configurations of sheets of paper.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part, hereof, in which.

It should, of course, be understood that the description and drawings herewith are merely illustrative and that various modifications and changes can be made in the structure disclosed without departing from the spirit of the invention.

DESCRIPTION OF THE PREFERRED EMBODIMENT

Figure 1:
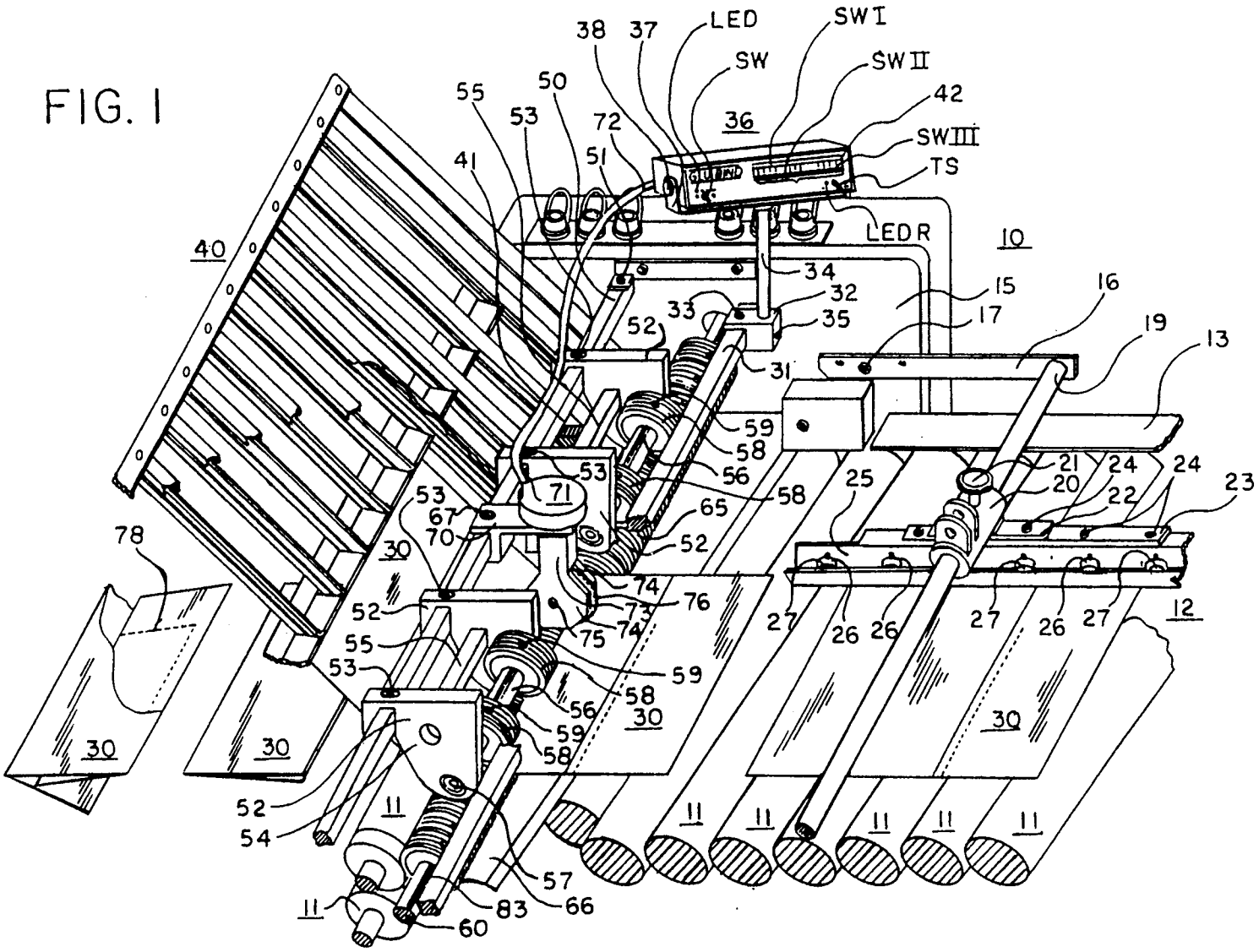
FIG. 1 is a fragmentary, perspective view, partially broken away of the apparatus of the invention in place in a paper folding machine.
Figure 2:
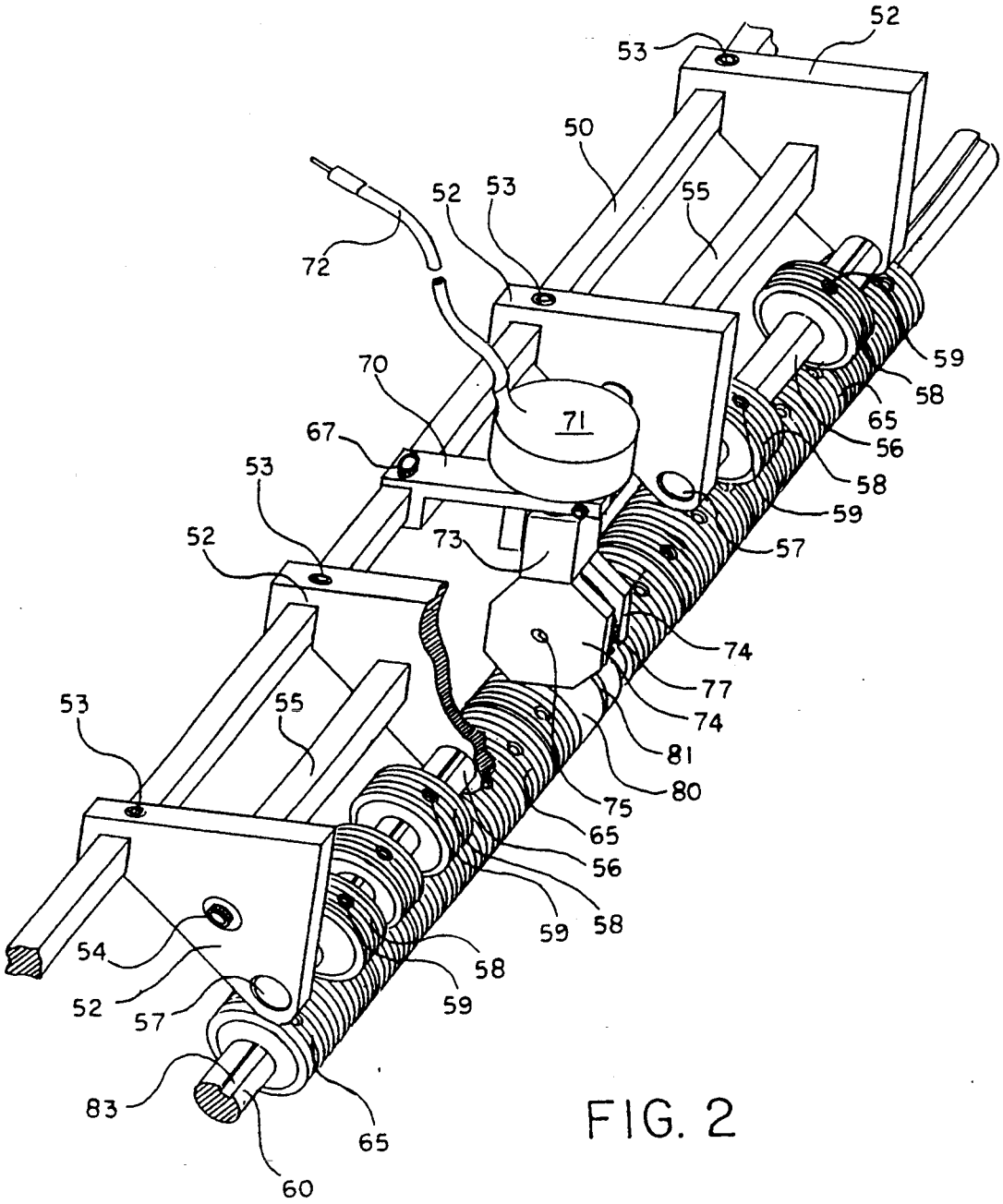
FIG. 2 is a fragmentary perspective view, enlarged, and partially broken away of a portion of the apparatus illustrated in FIG. 1.
Figure 3:
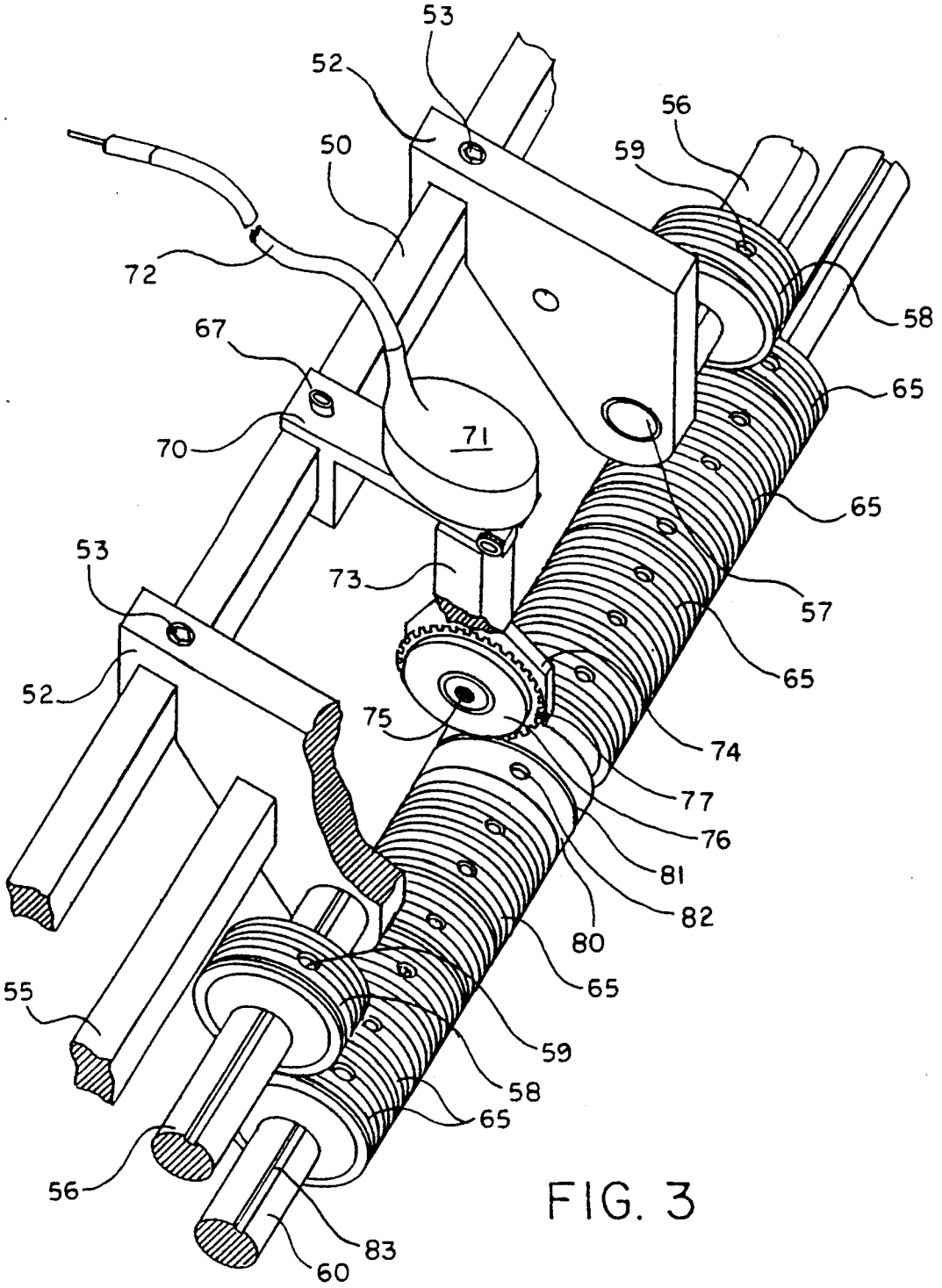
FIG. 3 is a fragmentary perspective view, similar to FIG. 2, but of larger scale.
Figure 4:
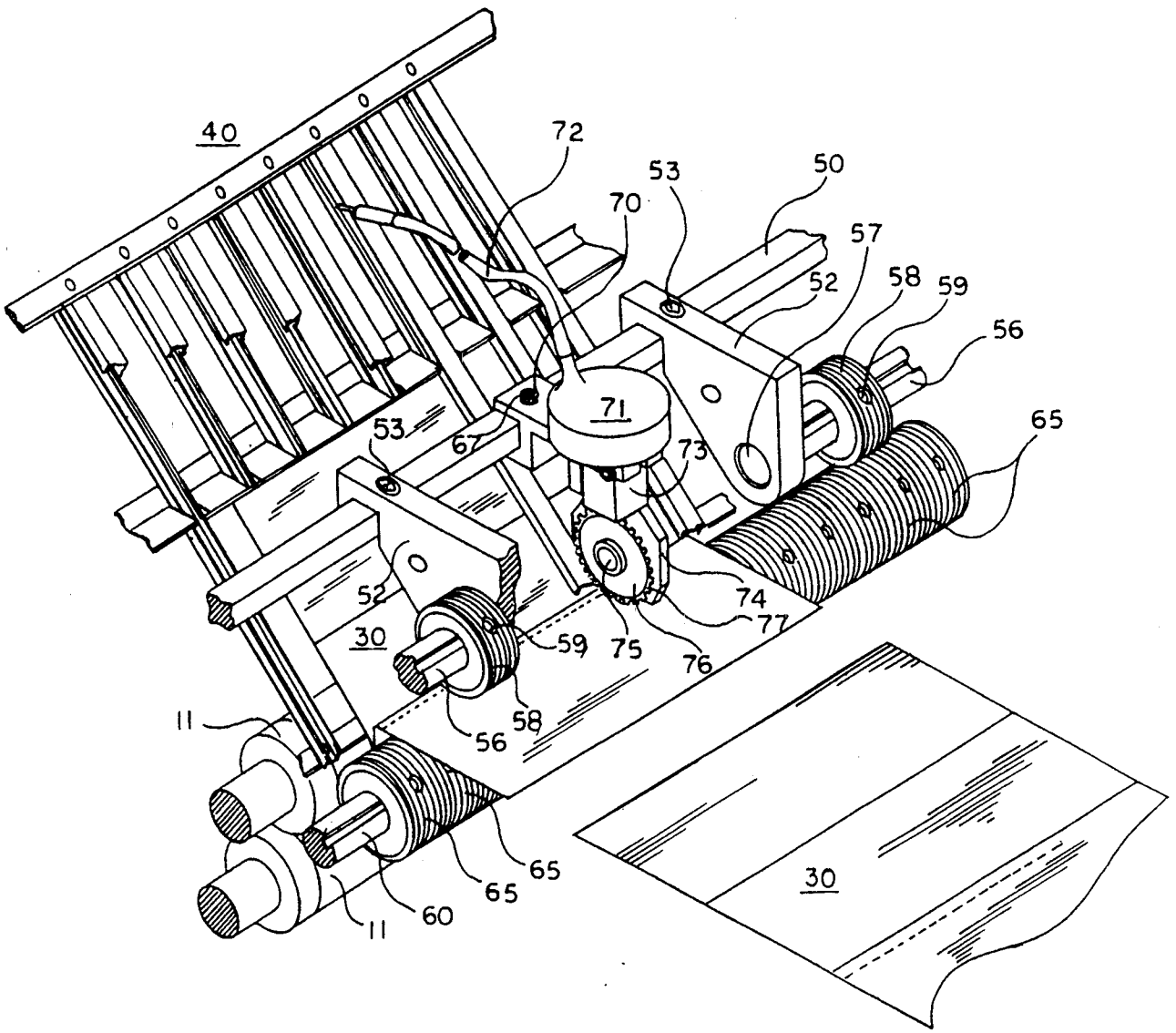
FIG. 4 is a fragmentary perspective view, partially broken away, illustrating perforation operations being performed on sheets of paper in the machine as illustrated in FIG. 1.

Referring now more particularly to the drawings and FIGS. 1 to 4, thereof, a portion of a paper folding machine 10 is therein illustrated. The machine 10 as seen starting at the right of FIG. 1 includes a plurality of driven transport rollers 11, which extend transversely across the bed 12 of machine 10.

The machine 10 includes a side guide plate 13 above rollers 11, which is fastened at one end to a side plate 15. An arm 16 is fastened to the side plate 15 by screws 17 and extends horizontally to the right. A fixed shaft 19 is fastened to arm 16 and extends transversely across machine 10 to another arm (not shown) on another side plate (not shown) of the machine 10.

The fixed shaft 19 has a bracket 20 slidably mounted thereon, with a screw 21 therein to engage the shaft 19 and lock the bracket 20 at selected locations. The bracket 20 has a plate 22 which is fastened to a plate 23 by screws 24. The plate 23 is fastened to a marble guide plate 25 by screws 24, which plate 25 has a plurality of openings 26, which contain marbles 27 of well known type, which are shown as resting on a sheet of paper 30 to which a line of perforations is to be subsequently applied.

The side plate 15 has a rod 31 secured thereto in well known manner, which extends transversely across the machine 10, and is secured to the other side plate (not shown) of the machine 10. The rod 31 is of square configuration with a block 32 engaged thereon, with a screw 33 therein to lock the block 32 at a desired location on rod 31. The block 32 has a vertically extending pole 34 therein, which is retained by a screw 35 in the block 32. The pole 34 has a U shaped cradle 37 thereon which carries a controller 36 therein, to be described, and retains it by screws 38.

A fold plate 40 of well known type is mounted to and extends transversely across the bed 12 of the machine 10, at an angle thereto, in well known manner.

A sheet detector 41 is mounted adjacent the fold plate 40 and connected by a cable (not shown) to the controller 36. The sheet detector 41 can be of the electric eye type, which when a beam of light is interrupted provides a signal to the controller 36.

The sheet detector 41 can also be used in conjunction with a linear motion sensor (LMS) (not shown) which is mounted so that it engages a transport roller 11 near the fold plate 40, and reads the linear motion of the paper sheets 30 to provide an input signal to the controller 36.

The controller 36 is a #2000 available from Dick Moll & Sons, Inc., Warminster, Pa., and includes a front panel 42 with the functions of delay, time, and lockout illustrated thereon. The front panel 42 has an led light (LED) to indicate that transmitted light is being received by the detector 41.

The panel 42 also has a switch (SW) which is set to determine if a dark to light, or a light to dark transition at the detector 41 is to be used to initiate a perforation cycle.

The panel 42 has an L.E.D. light (LEDR) to indicate that the controller 36 is ready to accept another sheet of paper 30.

The controller 36 has a make ready/hold toggle switch (TS), which allows the operator to jog a sheet of paper 30 into position for an single perforation cycle, so that he can observe where a line of perforations will start and stop.

Three sets of switches SWI, SWII, and SWIII are also provided.

SWI sets the delay in inches from the edge of a sheet 30 being detected to the start of a line of perforations.

SWII set the distance in inches (time) from the start to the stop of a line of perforations.

SWIII set the overall size in inches of the full length of a sheet 30 (lockout) from the time it is detected through its full length, so that the apparatus only cycles once per sheet 30.

A rod 50 is provided adjacent fold plate 40, secured to side plate 15 by bracket 51, and which extends transversely across the bed 12 of machine 10, and is secured to the other side plate (not shown).

The rod 50 is of square configuration in cross section, and has a plurality of idler plates 52 thereon, four being illustrated, in sets of two. The idler plates 52 are of a generally L shape, retained to and lockable on rod 50 by screws 53 engaged therewith.

The plates 52 are connected in pairs by rods 55 engaged therewith and retained thereto by bolts 54, and have shafts 56 carried in bearings 57 in the plates 52. The shafts 56 each have a pair of idler fold rollers 58 thereon, which are secured to shafts 56 by screws 59, and which permit positioning therealong. The idler rollers 58 are preferably of rubber, and engage the sheets 30. A driven shaft 60 is provided which is driven by a motor (not shown) and is below shaft 56.

The driven shaft 60 has a plurality of segmented fold rollers 65 thereon of well known type, opposite to idler fold rollers 58, to engage sheets 30 therebetween for feeding to fold plate 40.

The rollers 65 and 58 replace the first set of fold rollers found in folding machines.

A transition plate 66 is provided, which extends from transport rollers 11, to fold rollers 58 and 65, to deliver sheets 30 from transport rollers 11 for the application thereon of a line of perforations to be described.

The rod 50 has a bracket 70 engaged therewith, and movable thereacross, with a screw 67 which can be engaged to position bracket 70 along rod 50 as required. The bracket 70 carries an electro-hdraulic solenoid 71, which is connected to controller 36 by cable 72, and has an output arm 73. The arm 73 has two spaced apart plates 74, and with a shaft 75 engaged therein. The shaft 75 has a wheel 76 thereon, with a male serrated edge 77 to apply a line of perforations 78 to sheets 30, to be described, upon downward movement of arm 73.

The shaft 60 below edge 77 of wheel 76 has a female collar 80 thereon, with a groove 81 therein, and which is retained on the shaft 60 by screw 82 in groove 83 in shaft 60. The collar 80 in combination with the wheel 76 provides a line of perforations 78 on sheet 30.

While the controller 36 is a preferred device for actuation and control of the solenoid 71, a set or sets of electric eyes (not shown) can be substituted, which detect the presence of the leading and trailing edges of a sheet 30, are connected to solenoid 71, and thereby control the application of a line of perforations 78.

The mode of operation will now be pointed out.

When it is desired to put a line of perforations 78 on a sheet 30, a single sheet 30 is placed on transport roller 11. While there are several different ways that the controller 36 and sheet detector 41 can be adjusted, the following is preferred.

The sheet detector 41 is set to detect a sheet 30 at a location adjacent the fold plate 40.

The sheet 30 is marked at the location where the line of perforations 78 are to begin, and moved under wheel 76.

The delay switch SWI is set for 0 delay, the switch SW is set to read dark to light. The switch TS is set to make ready, the lockout switch SWIII is set to the length of a single sheet 30, and the switch SWII is set to determine the length of the line of perforations 78 from start to finish. The machine 10 is cycled once to verify that the settings are correct.

When the settings have been made and checked, sheets of paper 30 are fed onto roller 11, which transports them to plate 60 and between fold rollers 58 and 65 and between wheel 76 and female collar 80.

When the edge of a sheet 30 is detected by the sheet detector 41, the controller 36 is signaled by the sheet detector 41 which causes the controller to energize the solenoid 71, which moves the arm 73 and wheel 76 vertically downwardly until it contacts a sheet 30 and starts a line of perforations 78.

The operation continues until the sheet 30 has travelled the preset delay time, when the solenoid 71 is de-energized or released, and causes the arm 73 to move upwardly disengaging the wheel 76 from the sheet 30.

The sheet 30 is then fed to the fold plate 40, and beyond for the desired folding operations.

The operation continues with a line of perforations 78 placed on each sheet 30 is described.

It will thus be seen that apparatus has been provided with which the objects of the invention are achieved.

I claim:

1. In combination with a paper processing machine which includes a plurality of driven transport rollers to receive sheets of paper and the like and transport them in a straight line, apparatus for detecting the presence of sheets of paper, applying at least one line of perforations at selected locations and of controlled length, and feeding the sheets for further processing which comprises:

a lower driven shaft to receive sheets of paper therefrom which is below and after said transport rollers and extends transversely across said apparatus, at least one roller segment on said shaft, at least one female collar on said shaft and selectively positioned therealong at the location where said perforation line is to be applied to said sheets, a rod connected to said apparatus, and extending above and transversely across said apparatus, a plurality of idler plates on said rod, at least one idler shaft carried by said idler plates, above said lower driven shaft, a plurality of roller elements on said idler shaft, a bracket carried on said rod between said idler plates and selectively positionable therealong above said collar, an electrically actuated solenoid on said bracket, a vertically movable output arm extending downwardly from said solenoid, a perforation wheel carried by said arm which applies a line of perforations to said sheets when said output arm is moved downwardly, so that said sheets are contacted by said wheel and said collar, sheet detector means on said machine to detect the presence, or absence of a sheet of paper, and control means connected to said solenoid and to said sheet detector means which upon receipt of a signal from said sheet detector means, signals said solenoid to cause said solenoid arm to move downwardly whereby said line of perforations is applied to said one of said sheets.

2. Apparatus as defined in claim 1 in which said sheet detector means includes at least one electric eye.

3. Apparatus as defined in claim 1 in which a transition plate is provided to support the sheets of paper from said rollers to and between said perforation wheel and said collar.

4. Apparatus as defined in claim 1 in which said sheet detector means includes a linear motion sensor engaged with one of said transport rollers and which provides input signals to said control means.

* * * * *